United States Patent [19]

Hustad

[11] Patent Number: 5,074,416

[45] Date of Patent: Dec. 24, 1991

[54] PACKAGE WITH RECLOSEABLE BOARD SEAL

[75] Inventor: Gerald O. Hustad, McFarland, Wis.

[73] Assignee: Oscar Mayer Foods Corporation, Madison, Wis.

[21] Appl. No.: 628,509

[22] Filed: Dec. 14, 1990

[51] Int. Cl.[5] ..... B65D 81/20

[52] U.S. Cl. ..... 206/524.8; 206/467; 206/471; 220/355; 426/106; 426/129

[58] Field of Search ..... 206/524.8, 631.1, 632, 206/471, 467; 229/123.1; 383/61, 63; 220/355, 359, 4.21; 426/122, 121, 123, 129, 106

[56] References Cited

U.S. PATENT DOCUMENTS

| | | | |
|---|---|---|---|
| 3,055,540 | 9/1962 | Ringlen . | |
| 3,229,810 | 1/1966 | Gollier et al. | 206/467 |
| 3,325,084 | 7/1967 | Ausnit . | |
| 3,371,848 | 3/1968 | Ward et al. . | |
| 3,454,158 | 7/1969 | Tigner . | |
| 3,650,386 | 3/1972 | Tigner | 206/524.8 |
| 3,676,159 | 7/1972 | Fallowfield | 229/123.1 |
| 3,703,384 | 11/1972 | Seiferth et al. | 426/121 |
| 3,873,735 | 3/1975 | Chalin et al. . | |
| 3,943,987 | 3/1976 | Rossi | 206/524.8 |
| 4,055,671 | 10/1977 | Mahaffy et al. | 229/123.1 |
| 4,246,288 | 1/1981 | Sanborn . | |
| 4,278,693 | 7/1981 | Dingethal et al. | 206/471 |
| 4,354,541 | 10/1982 | Tilman | 383/63 |
| 4,437,293 | 3/1984 | Sanborn . | |
| 4,619,021 | 10/1986 | Johnson | 383/63 |
| 4,782,951 | 11/1988 | Griesbach et al. . | |
| 4,823,961 | 4/1989 | Griesbach et al. . | |
| 4,850,504 | 7/1989 | Grindrod et al. . | |
| 4,851,246 | 7/1989 | Maxwell et al. | 426/120 |
| 4,901,505 | 2/1990 | Williams, Jr. | 426/123 |

FOREIGN PATENT DOCUMENTS

| | | | |
|---|---|---|---|
| 0384588 | 8/1990 | European Pat. Off. | 383/61 |

*Primary Examiner*—Stephen Marcus
*Assistant Examiner*—Christopher McDonald
*Attorney, Agent, or Firm*—Lockwood, Alex, Fitzgibbon & Cummings

[57] ABSTRACT

A recloseable package is disclosed wherein the enclosed product is packaged between first and second package panels in which one of the two package panels has a recloseable seal element integrally formed therein. The other package panel contains a complementary and opposing, recloseable seal element which engages the formed recloseable seal element to define a recloseable seal. The two package panels are further hermetically sealed around their periphery interior of the recloseable seal.

17 Claims, 3 Drawing Sheets

FIG. 5
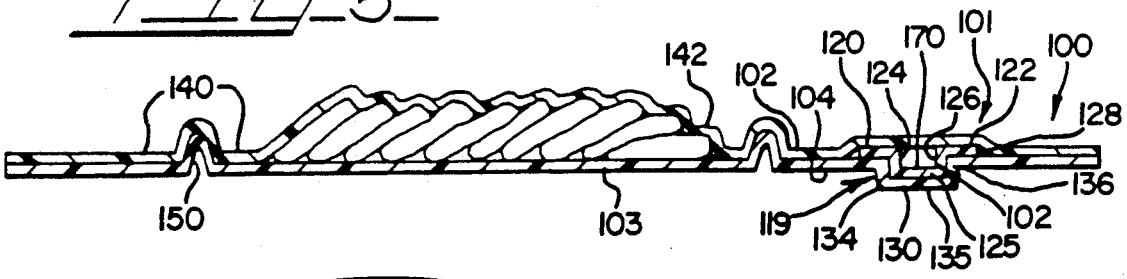
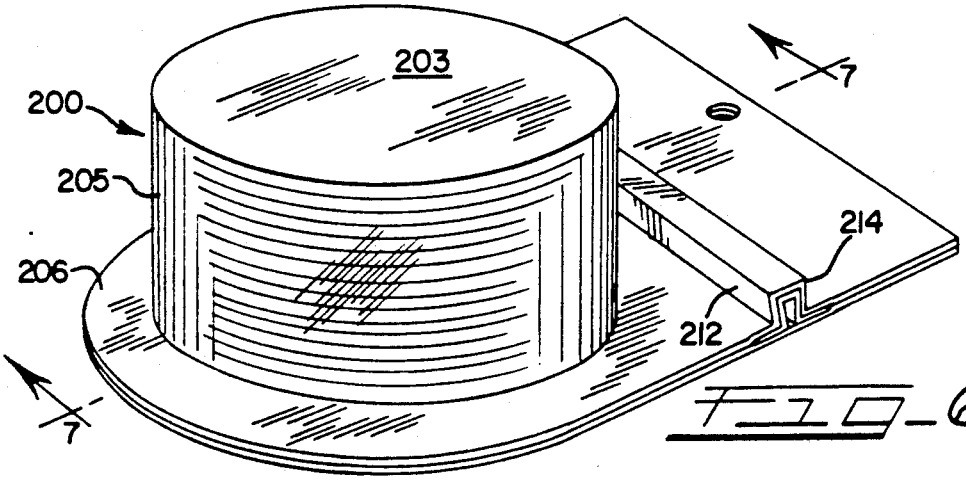
FIG. 6
FIG. 7
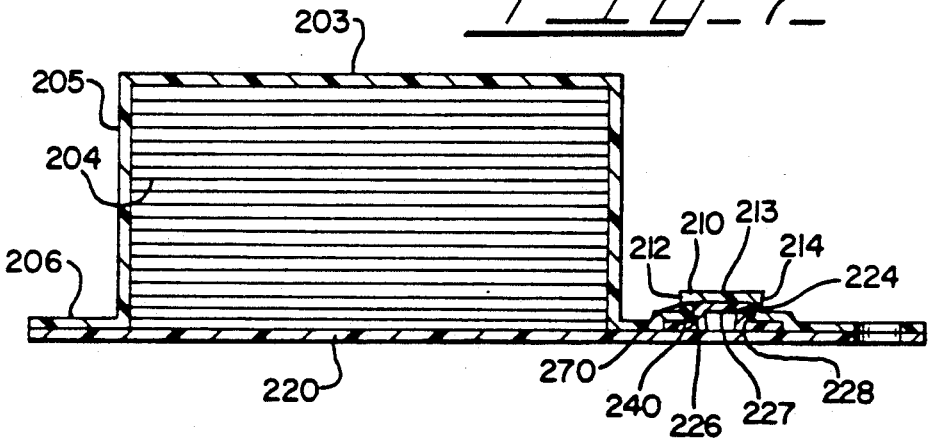
FIG. 8
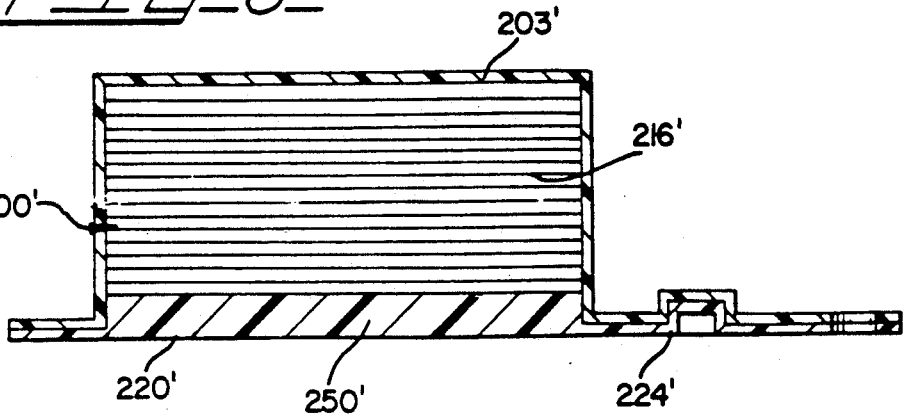

PACKAGE WITH RECLOSEABLE BOARD SEAL

BACKGROUND AND SUMMARY OF THE INVENTION

The present invention relates generally to recloseable packages for hermetically sealing consumable products between a rigid package base member and an opposing sheet of package film. More particularly, the present invention relates to recloseable packages for food products and the like in which a portion of the package base member has a recloseable seal fastener element.

Certain processed meats and/or food products sold to consumers are sold in packages in which the processed meats for food products are mounted on a package base. The freshness of these food products such as bacon, sliced luncheon meats, cheeses and the like contained within these packages depends upon the extent to which the package is vacuum packed or gas flushed and subsequently hermetically sealed. Often, the purchaser does not use the food products contained within such packages at once, but rather uses them over an extended period of time. When the initial hermetic seal of the package has been breached during opening of the package, a portion or portions of the package are often removed. In such instances, the package cannot be effectively resealed in a manner to preserve the freshness of the food products stored within. The purchaser must often repack the food products in a different suitably recloseable container. Mounting recloseable fastener elements on opposing surfaces of the base and covering film may provide a recloseable feature to such a package. However, the recloseable fastener elements are typically applied as separate elements to both the base and covering films, which leads to increased manufacturing cost and additional steps in the manufacturing process. Accordingly, a need exists for an improved food product package having a package base which has a recloseable seal element integrally formed therein.

The improved packages of the present invention provide significant advantages in that one portion of the recloseable seal is integrally formed in the package base at a desirable position which is preferably proximate to the package mouth. A hermetic seal is provided between the base and the covering film which extends around the entire periphery of the product, interior of the integral recloseable seal, so that the package is liquid tight and suitably retains within the package, fluids of the products contained therein, including water, juices, oils and the like, while the package recloseable seal permits the package to be easily opened and closed repeatedly to remove portions of the package contents without destroying the integrity of the package.

The hermetic seal disposed between the base and the covering film which extends around the periphery of the product has an easy open or peel seal portion located adjacent the product and interior of the recloseable seal. The recloseable seal is opened with digital pull-apart forces which are also used to open the peel seal. The peripheral hermetic seal can effectively maintain any desired vacuum, pressurized and/or gas-flushed environment within the package. The peel seal area of the hermetic seal will be formed by effecting a face-to-face seal between a plastic film and the product backing board around the periphery of the product with the strength of the seal permitting separation without destruction or tearing of the plastic film.

The recloseable seal of the package of this invention is formed in the package base proximate to an access edge thereof. One of the recloseable seal interengaging fastener elements is integrally formed directly in the base while the other, or complementary, interengaging fastener element is adhered directly to the package plastic film sheet. In this construction, the possibility that the packaging material may tear or separate when the hermetic seal is opened is greatly decreased.

Accordingly, it is a general object of the present invention to provide an improved recloseable package for use with products positioned on a package base member which has a first recloseable seal formed within the base member along an access edge of the base member and a second hermetic peel seal disposal peripherally adjacent to the product and adjacent the recloseable seal.

Another object of the present invention is to provide a recloseable package for food products and the like having an integral recloseable seal disposed near an opening of the package and attached to the package base member and a hermetic seal interior of the recloseable seal, the hermetic seal having a peelable seal area adjacent to and interior of the recloseable seal.

Yet another object of the present invention is to provide an improved product package having a peel seal and a recloseable seal, wherein the opposing, recloseable seal elements are integrally formed in the product supporting package member and in the outer, covering film sheet.

Still another object of the present invention is to provide a recloseable package for food products and the like having a base member for supporting the food product, the base member being formed from a rigid packaging film with a recloseable fastener element formed therein, and the package covering film having a separate, complementary recloseable fastener adhered to the covering film, the two fastener elements interengaging each other to form a recloseable seal.

These and other objects of the present invention will become more readily apparent from a reading of the following detailed description.

BRIEF DESCRIPTION OF THE DRAWINGS

FIG. 5 is a cross-sectional view of still another embodiment of a package incorporating the principles of the present invention;

FIG. 6 is a perspective view of yet another embodiment of a package incorporating the principles of the present invention;

FIG. 7 is a cross-sectional view taken along line 7—7 of FIG. 6; and FIG. 8 is a cross-sectional view of another embodiment of a package incorporating the principles of the present invention.

DETAILED DESCRIPTION OF THE PREFERRED EMBODIMENTS

Figure 1:
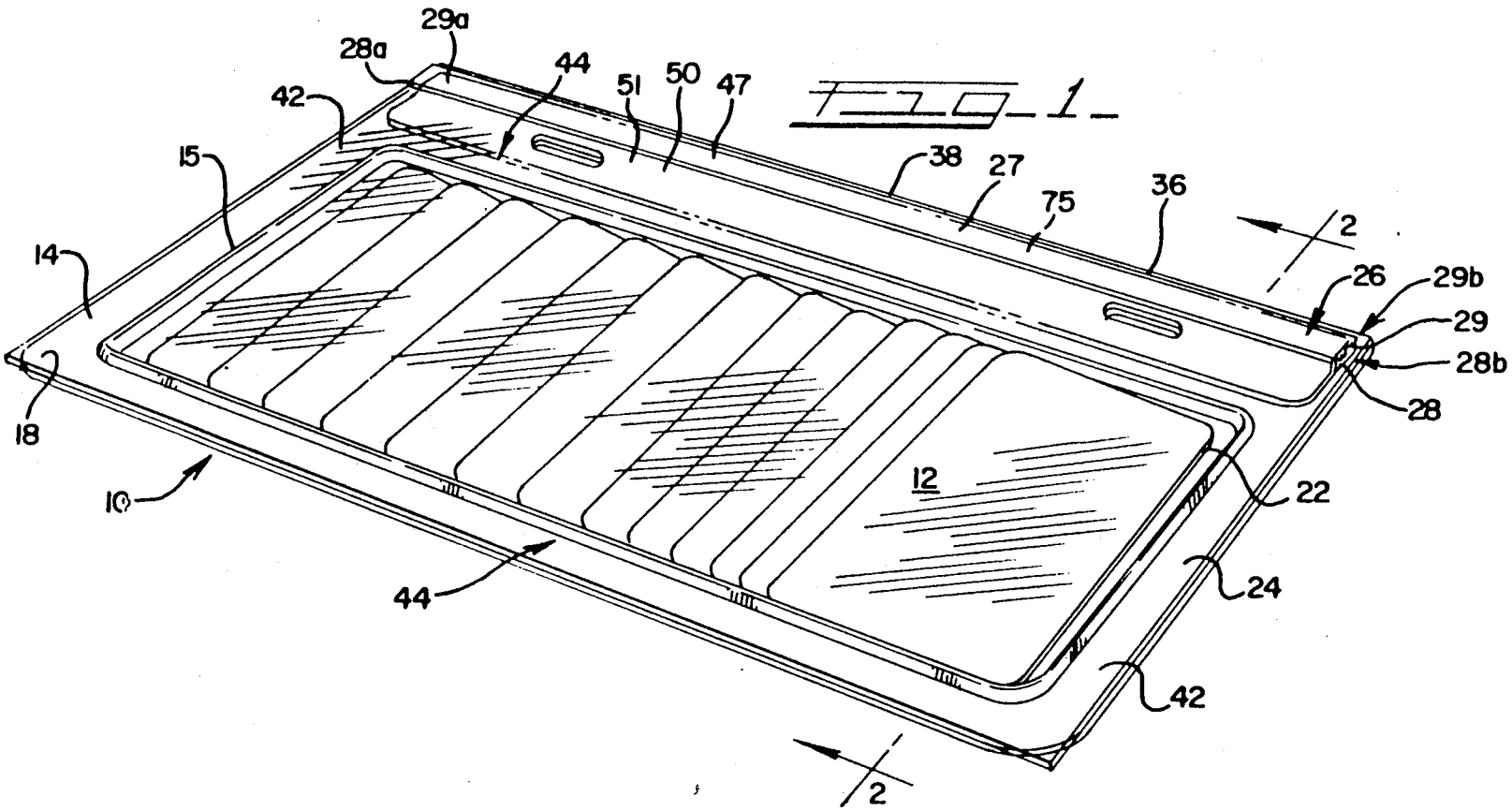
FIG. 1 is a perspective view of one embodiment of a package incorporating the principles of the present invention. For purposes of illustration only, the package is shown as containing vacuum-packed luncheon meats.

FIG. 1 illustrates a recloseable package 10 constructed in accordance with the principles of the present invention. The packages 10 of the present invention are particularly suitable for sealing a perishable food product, shown in the Figures as luncheon meat slices 12, between one sheet or panel 14, of a flexible packaging film material and a rigid package base member 18 which supports the product 12 during assembly of the packages. The film sheet 14 which forms one sidewall, or the covering film of the package 10 (shown as the top of the package in FIG. 1 and as the rear of the package in FIGS. 6 and 7) can be made from a variety of materials including plastic films, multi-layered laminates or co-extrusions, thermoformable materials and the like. A preferred plastic film for assembly of the packages of the present invention is one which is impervious to air, oxygen and/or moisture.

When the package film sheet 14 is formed from a laminated construction, it is desirable to use a thin, inner layer which is impervious to air, oxygen or moisture in combination with an outer layer having sufficient flexibility and desirable structural characteristics so that the laminate can function as a package sidewall lamina. In actual practice, each film sheet will likely be a laminate of two or more layers which will provide sufficient protection to the product (e.g., oxygen and moisture barriers) and which can form a hermetic, and if desired, peelable seal at thin inner surfaces. As is known in the art, laminates comprised of vinylidene chloride polymer plastic films, such as "Saran", polyvinyl chloride, or ethylene vinyl acetate plastic film are suitable. When the film sheet 14 is of a laminated construction, it is preferable to have a layer of a material possessing the suitable qualities desirable for hermetic sealing such as Saran or polyvinyl chloride disposed on the inner surface 17 of the film sheet which will contact the package base member 18. It is desirable to use a relatively thin thermoplastic plastic film for the backing board which is impervious to air, oxygen or moisture and which is somewhat flexible and yet rigid enough to provide adequate support for the product during assembly of the package as well as the rigors of handling after assembly. In this regard, suitable materials are Barex®, polyethylene, polypropylene, polyvinyl chloride (PvC), polyethylene terephthalate (PET) or high-impact polystyrene (HIPS). All of these materials are suitably rigid for their intended purpose.

Figure 2:
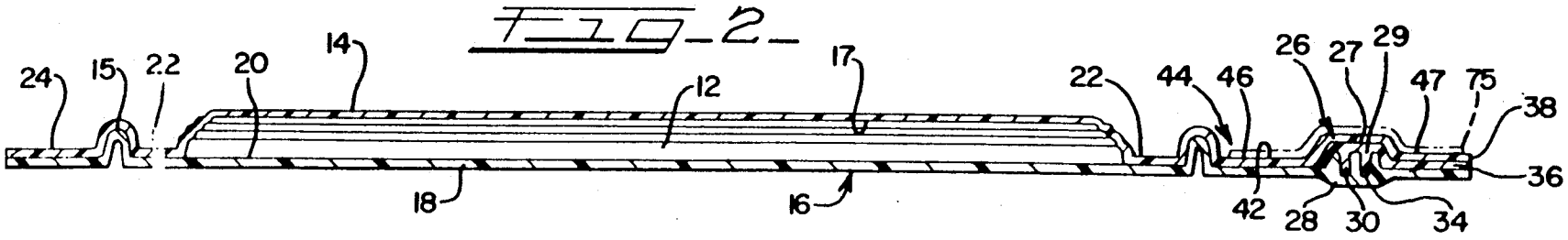
FIG. 2 is a cross-sectional view taken along line 2—2 of FIG. 1.

FIGS. 1 and 2 illustrate a package 10 in which one film sheet 14 encloses a plurality of luncheon meat slices 12 positioned on a generally rectangular and flat base member or backing board 18, sometimes referred to as "bacon" boards. In this particular configuration, the backing board 18 provides a support surface 20 for the luncheon meat slices 12. The luncheon meat slices 12 or the like are desirably positioned on the backing board 18 within a means for containing the slices in a product support area 16, illustrated as a raised portion or wall 15 formed in the backing board 18. Not only does the raised portion 15 retain the luncheon meat 12 within the packaged product area 16, but it also confines any juices, oils, or fluids from the luncheon meat within the product area 16. As mentioned above, the raised portion 15 can be formed integrally within the backing board 18, such as by molding. Alternatively, the raised portion 15 can be formed by attaching a separate member to the backing board 18.

The covering film sheet 14 and the backing board 18 are combined together to form the package 10 by contacting each other around the luncheon meat 12. This contact forms an inside border area 22 within the backing board raised portion 15 extending around the periphery of the product as positioned on the backing board 18 within the raised portion 15. A peripheral margin 42 is further formed which extends substantially around the entire periphery of the product containment means raised portion 15. When a vacuum is applied to the space between the film sheet 14 and luncheon meat 12, the covering film sheet 14 is drawn inwardly about the luncheon meat 12 or the like to conform to the contour thereof to provide the package 10 with improved rigidity for withstanding rigorous handling during transport and retail display and the like. When a laminated film is used wherein the inner surface 17 of the film sheet 14 which contacts the backing board 18 is formed from either a layer of ethylene vinyl acetate or Saran, the inherent adhesive qualities of the ethylene vinyl acetate or Saran laminate form a secure, yet peelable, hermetic continuous edge seal 24 outside the board raised portion 15, which maintains a secure seal during handling and storage that can be peeled back upon the application of digital forces applied through the package first, outer recloseable seal 26.

The rectangular package has a first, outer recloseable seal 26 illustrated as a conventional interengaging fastener assembly 27 such as a "zipper" fastener assembly. The outer recloseable seal 26 has two, separate seal components 28 and 29. One of these recloseable seal components 28, shown in FIG. 2 as the lower seal component is integrally formed as a "zipper" element in the product backing board 18 during the manufacture thereof. This forming can be easily accomplished through conventional means such as molding, thermoforming or stamping. The lower seal component 28 extends in the backing board !8 for the entire width thereof and is located therein proximate to an access edge 38 of the backing board 18.

Figures 3, 4:
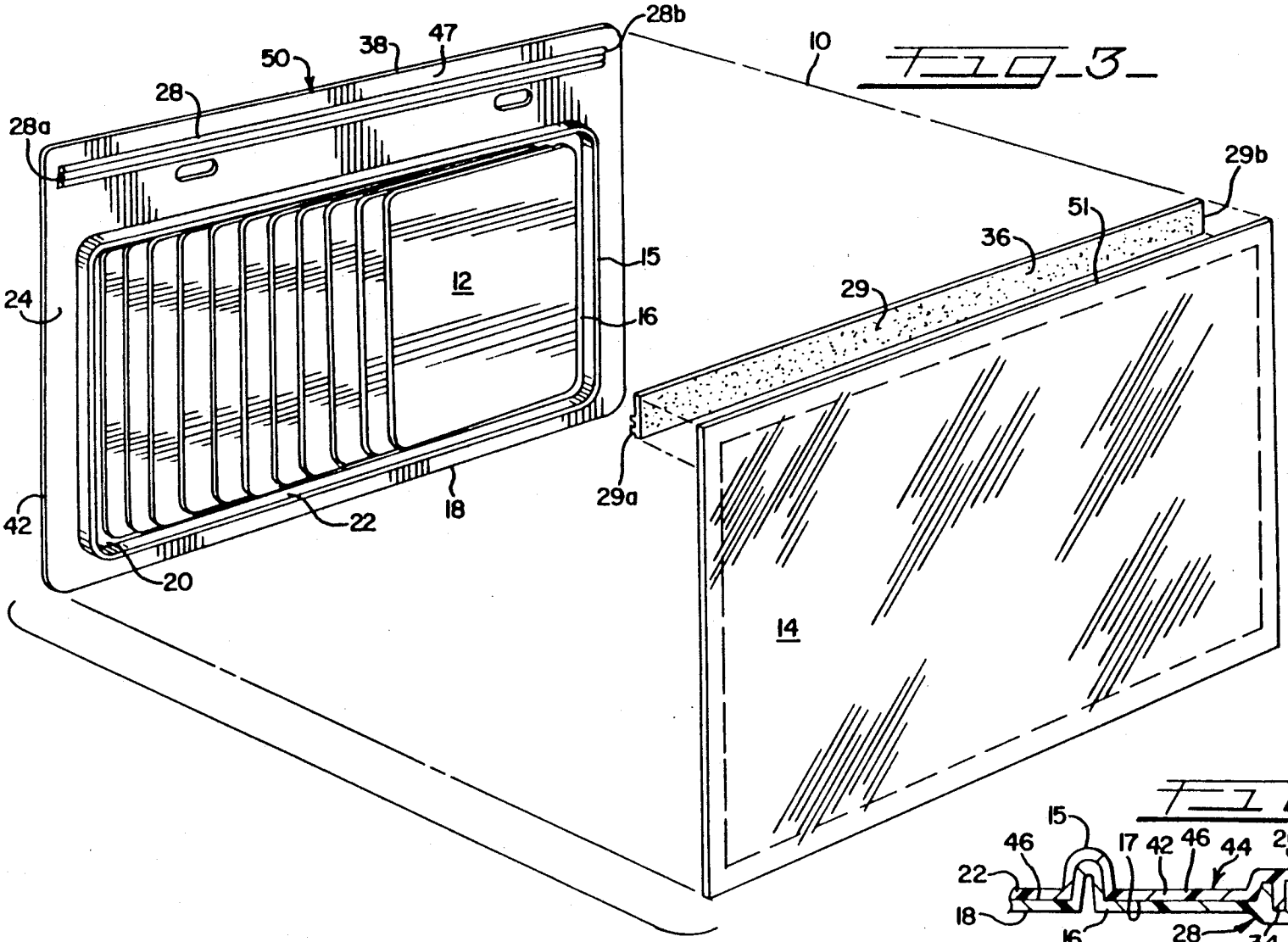
FIG. 3 is an exploded perspective view of the package of FIG. 1.
FIG. 4 is a cross-sectional view of another embodiment of a package incorporating the principles of the present invention.

The other complementary, or upper recloseable seal component 29 is disposed along the inner surface 17 of the covering film sheet 14 and may be integrally formed in the film sheet 14 as shown in FIG. 4. Alternatively, as shown in FIGS. 1-3 the upper recloseable seal component 29 may be separately formed as a "zipper" element having attachment means in the form of a relatively wide base portion or flange 36 which extends transversely to the fastener element 29. The flange 36 has a width sufficient to provide an appropriate surface to adhere and permanently seal the upper fastener element 29 to the covering film 14 without fear of the upper fastener element 29 separating from the covering film sheet 14 when the digital pull-apart forces are applied to recloseable seal 26 to open it. If desired, the upper fastener element sealing flange 36 can extend up to the package mouth 50 and provides an additional thickness to the covering film 14 so that it serves as a pull flange 51 which easily enables the user to grab the covering film sheet 14 and open the recloseable seal 26. Other ways of forming the upper recloseable seal component 29 may include depositing a bead (309) of hot melt adhesive or polyethylene on the inner surface 17 of the covering film sheet 14 as well as folding the covering film sheet 14 upon itself to form a thickened portion which engages the lower film sheet 16 recloseable seal component. The opposite, longitudinal ends 29*a*, 29*b* of the upper fastener element 29 are preferably permanently adhered to the opposite ends 28*a*, 28*b* of the backing board fastener element 28 to provide a durable recloseable seal 26 and package mouth 50 which resists tearing and separation. These opposing ends of the interengaging fastener elements 28, 29 are preferably permanently sealed by an appropriate means such as suitable adhesive, heat sealing, ultrasonic welding or the like.

The interengaging fastener assembly 27 shown in FIGS. 1-3 is illustrated as one that is particularly secure for the illustrated type of package 10, namely, a "zipper" construction having a length of a formed double rib element 28 formed in the backing board and a similar length of a formed double groove element 29 disposed on the covering film. However, it will be noted that the interengaging fastener elements 28 and 29 of the recloseable seal 26 are not limited to any particular number of interengaging fastener elements. The ribs 30 of the upper fastener element 29 need only project outwardly therefrom a sufficient distance to be securely interengaged with and held by their confronting and complementary counterparts in the lower, opposing fastener element 28. The double groove element 28 shown includes three outwardly extending walls which define two channels or grooves 34 therebetween. The grooves 34 are of sufficient width to firmly engage the ribs 30 when the confronting faces of the interengaging fastener strips 28, 29 are pressed together. Both the recloseable seal 26 and the interengaging fastener assembly 27 can take any number of various characteristics and configurations in addition to those described herein.

Alternatively, as illustrated in the embodiment illustrated in FIG. 5, packages 100 of the present invention can be constructed with non-zipper type fastener elements. In such instances, it is preferable to apply a separately thermoformed fastener element strip 120 to the inner surface 104 of the package covering film 102. The covering film sheet 102 is applied to a lower or base film sheet 103 to form the basic package. The upper, or covering film fastener element 102 has an outwardly extending rib member 122 (or downwardly as oriented in FIG. 5) having two substantially flat sidewalls 124, 126 which are generally parallel and which are interconnected by a rib base 125. The upper fastener element rib member 122 interfittingly engages a lower or base film fastener element 119 which is integrally formed in the base film sheet 103. This lower fastener element has a groove or channel 130 formed therein, which is complementary in shape to the covering film rib member 122. In this regard, the groove 130 also includes two generally parallel sidewalls 134, 136 which are interconnected by a groove base 135. Preferably, the distance between the opposing sidewalls 134, 136 of the base member fastener element strip 119 is slightly less than the distance between the opposing sidewalls 124, 126 of the covering film fastener element strip 120 to provide the package 100 and the recloseable seal 103 with the desired recloseable features. The upper and lower fastener elements engage each other in telescoping engagement as shown in FIG. 5 to thereby provide the package 100 with a recloseable seal 112. In this regard, it should be noted that both the rib member sidewalls 124, 126 and the groove member sidewalls 134, 136 may be formed as substantially vertical sidewalls as shown in FIG. 5, or may be formed as angled sidewalls as best seen in FIG. 7. Alternatively, a layer of peelable adhesive 170 may also be applied to either of the opposing surfaces of the rib base 125, the groove base 135 or both.

The upper fastener element strip 120 may be adhered to the inner surface 104 of the package covering film 102 by way of one or two sealing flanges 128 Which extend transversely to the rib member 122. Any suitable attachment means such as by heat sealing, adhesive sealing, ultrasonic welding or the like may be used to accomplish this. The package 100, similar to the embodiments described above, has a hermetic seal 140 formed between the inner surface 104 of the covering film 102 and the package base member 103 which hermetic seal is disposed interior of the recloseable seal 101 and further interior and exterior of the product containment means or raised wall portion 150. As mentioned above, this hermetic seal 140 preferably extends around substantially the entire periphery of the product support area 142 both interior and exterior of the base film raised wall 150.

The present invention can also be applied to "bubble" type packages, such as the package 200 illustrated in the embodiment of FIGS. 6 and 7 wherein the package includes a formed, generally circular "bubble" top or product support component 203 positioned on a rectangular base peripheral flange 206. The product support member 203 includes a product cavity 204 formed therein and having a product support wall 205 extending perpendicularly from the base film 203. This flange 206 has a groove 210 thermoformed therein which has a cross-sectional configuration slightly different from that illustrated in FIG. 5 and as discussed above. The groove 210 is disposed in the base film 203 proximate to an access edge thereof and has a pair of angled sidewalls 212, 214 which are interconnected by a groove base 213.

The product support component 203 can utilize a flat covering film 220 as shown in FIG. 6 which is applied to the base film or support member 203 and recloseably engages the same by way of a separately formed fastener element 240 applied thereto. This covering film fastener element 240 has an extending rib 224 which is defined by two angled sidewalls 226, 228 interconnected by a base 227 which sidewalls are complementary to the groove sidewalls 212, 214. The rib 224 is complementary in configuration with the opposing support member fastener element 242 and interferingly engages therewith. As mentioned above, the opposing surfaces of the rib and groove bases, 227, 213 respectively may include a releasable adhesive 270 to assist in imparting recloseability to the seal. Alternatively, as shown specifically in FIG. 8, the covering film 220' which covers the back or bottom of the package 200' seals the product 216' in the product cavity 204' may include an upraised pedestal portion 250' which projects partially into the product cavity. In such a construction, the covering film fastener element 224' may be integrally formed in the covering film 220'.

A hermetic, yet peelable seal 230 is provided between the inner surface of the package covering film 220 and the peripheral flange 206 of the product support member 203 and substantially surrounds the product containment means or product cavity 204.

In assembly of the packages of the present invention and with reference to the first embodiment but applicable to the other embodiments, after the interengaging fastener element 28 and the product retaining means are integrally formed in the backing board 18, the product 12 is positioned on the backing board 18 within the upraised portion 15 thereof to form a product-board assembly. In instances where the covering film fastener element 29 is a separate member, it may be engaged to its complementing lower fastener element 28 and the covering film sheet 14 may be then brought into contact with the backing board 18. Also in such instances, the integral fastener element 29 may be utilized to ensure proper registration of the covering film 14 onto the backing board 18 by interengaging the two fastener elements 28, 29 together. In instances where the upper interengaging fastener element 29 is integrally formed with the covering film sheet 14, both the covering film sheet 14 and the fastener element 29 may be contacted to the backing board 18 at once.

A vacuum is subsequently applied therebetween, and a package second, hermetic seal 44 is then formed between the backing board 18 and the covering film sheet 14 around the periphery of the product and interior of the first recloseable seal 26. The film sheet 14 is then permanently adhered to the upper recloseable seal fastener element 29 along the longitudinal surface of the fastener element flanges 36, by heat sealing, ultrasonic welding, by sealing with an adhesive, or by any other suitable means. In instances where the top or covering film sheet fastener element 29 is integrally formed in the covering film sheet 14, such an adhesion step is not necessary. Any air present between the film sheet 14 and the backing board 18 can be evacuated and/or the product 12 gas-flushed if desired.

It is desirable to make a portion 46 of the hermetic seal 44 which is interior of the recloseable seal 26 and exterior of the product 12 a peelable seal to allow the purchaser simple and easy access to the product 12. As illustrated in the Figures, this peelable seal portion 46 may be formed in the areas both within and outside of the backing board raised portion !5. The hermetic seal 44 may be entirely of a peelable nature with the hermetic seal portion thereof having a stronger bond effected between the film and the backing board peripheral margin 42 than in the peelable seal portion 46 interior of the recloseable seal 26 so that the hermetic seal 44 is, for all intents and purposes, non-peelable. A portion 47 of the hermetic seal 44 can be extended into the package area exterior of the recloseable seal 26 as shown best in FIGS. 1 and 3. In this regard, the recloseable seal element 28 formed in the backing board 18 does not extend completely to the longitudinal ends of the backing board 18, but rather terminates a short distance inwardly therefrom to provide areas of positive contact between the opposing package films.

In any event, because the hermetic seal 44 is positioned primarily interior of the recloseable seal 26 and because it extends up to the periphery of both the product 12 and the product retaining means 15, the likelihood of "leakers", i.e., packages wherein the product juices or oils escape from the product area 16 and enter the recloseable seal area, is greatly diminished.

Significantly, the production of packages of the present invention may be accomplished as a continuous process wherein the covering film recloseable seal fastener element 29, in the form of a continuous strip may be fed and applied to the access edge 38 of a continuous length of the backing board 18, the backing board having previously had an interengaging fastener element 28 formed therein, such that the fastener element 29 is interengaged with its complement 28. This continuous assembly of backing boards and fastener element strip are then preferably trimmed to the desired dimensions. The opposing ends 28*a*, 28*b* and 29*a*, 29*b* are then secured together to form the package mouth 50.

The individual backing board may then be transferred to a product application area. A preselected amount of luncheon meat 12 is subsequently deposited on the backing board 18 within the previously formed upraised portion 15 to form a product-backing board assembly, which is subsequently transferred to a packaging station where the film sheet 14 may be fed from supply rolls into a position opposite the product support surface 20 of the product-backing board assembly and into contact therewith at a peripheral margin 42 extending around the product-backing board assembly. The film sheet !4 is adhered to the recloseable seal fastener element flange 36 and is further bonded to the backing board 18 at the peripheral margin 42 thereof to form the package hermetic seal, extending either primarily interior or exterior of the recloseable seal assembly or both. After the film sheet 14 is bonded to the backing board !8, a package label 75 (shown in phantom) or other package graphics may be applied to the film sheet in a conventional manner.

When it is desired to open a finished package, the user grips the pull flange 51 of the covering film sheet 14 and applies digital pull-apart forces to open the peel seal portion 46 of the hermetic seal 44. The recloseable seal fastener elements 28, 29 will separate up to their opposing ends 28*a*, 28*b* and 29*a*, 29*b* and open, thereby allowing access to the inner peelable seal. The recloseable seal fastener elements 28, 29 separate and form a package mouth 50 between the backing board 18 and the covering film sheet 14. The recloseable seal 26 is adhered to the backing board 18 and attached at its ends, and therefore the likelihood of destruction of the integrity of the package 10 is greatly diminished.

It will be seen that while certain embodiments of the present invention have been shown and described, it will be obvious to those skilled in the art that changes and modifications may be made therein without departing from the true spirit of the scope of the invention.

I claim:

1. A recloseable package for hermetically sealing a product between two opposing package panels, in which a component of a recloseable seal of the package is integrally formed in one of the package panels comprising, in combination:

a first package panel in the form of a product backing board adapted to receive a preselected amount of product positioned thereon in a predesigned product support area;

means for containing said preselected amount of product within said predesignated product support area, the product containment means being disposed in and integrally formed on said backing board, said product containment means providing a first barrier to liquids associated with said product from migrating into the package recloseable seal, said first barrier being a wall raised above both said product backing board and said predesignated product support area;

continuous recloseable fastener means in the form of a pair of interengaging fastener elements, one of the pair of interengaging fastener elements being integrally formed in said backing board proximate to an access edge of said backing board, the other of said pair of interengaging fastener elements being disposed on an inner surface of said second package panel, the one interengaging fastener element being further disposed generally adjacent to the access edge of said backing board and defining a mouth portion of said package;

a second package panel in the form of a covering film sheet contacting and bonded to said backing board around a peripheral margin of said backing board which surrounds said predesignated product support area, said other of said pair of interengaging fastener elements being disposed on the inner surface of said covering film generally opposite said one interengaging fastener element, said other interengaging fastener element being secured at its opposing longitudinal ends to the opposing longitudinal ends of said one interengaging fastener element so as to form said recloseable package seal, said recloseable package seal being disposed near said package mouth portion and exterior of said product containment means, said backing board and said covering film sheet further being bonded together to form a hermetic package seal between said backing board and said covering film sheet inner surface, the hermetic package seal extending around substantially the entire periphery of said predesignated product support area and substantially the entire periphery of said product containment means, said hermetic package seal being disposed within said package exterior of said product containment means and interior of said recloseable seal, said hermetic package seal further including a first peelable portion disposed interior of said package recloseable seal and exterior of said product and a second peelable portion disposed interior of said product containment means and exterior of said product, said hermetic package seal second peelable portion providing a second barrier to migration of said product liquids from said product support area into said reclosable seal, said first and second barriers cooperating together to substantially prevent migration of said product liquids from said product support area into said recloseable seal.

2. The package of claim 1, wherein said other interengaging fastener element includes a separate, elongated interengaging fastener element strip adhered to said covering film sheet inner surface.

3. The package of claim 2, wherein said other interengaging fastener element includes at least one sealing flange extending transversely to said interengaging fastener element, the at least one sealing flange having a sealing surface opposing said covering film sheet inner surface, said covering film sheet being attached to said sealing flange along said sealing surface.

4. The package of claim 1, wherein said first and second peelable seal portions are formed by adhesive means.

5. The package of claim 1, wherein said first and second peelable seal portions are formed by heat sealing means.

6. The package of claim 1, wherein said covering film sheet is formed from a flexible, oxygen-impermeable laminated package film having an inner surface of a Saran film.

7. The package of claim 1, wherein said package covering film sheet is formed from a flexible, oxygen-impermeable laminated package film, having an inner surface of ethylene vinyl acetate film.

8. The package of claim 1, wherein said backing board has a generally rectangular shape and said product containment means is also generally rectangular in shape, said rectangular product containment means defining the peripheral margin of said backing board which surrounds said product support area, and said package covering film sheet is bonded to said backing board along the periphery of three edges of said backing board to form a permanent, hermetic seal peripheral adjacent to the three edges of said backing board.

9. The package of claim 1, wherein said backing board product containment means includes a raised portion which substantially surrounds the entire periphery of said predesignated product support area.

10. The package of claim 1, wherein said backing board is a formed thermoplastic member having a raised wall extending around and defining said predesignated product support area, and said one interengaging fastener element includes a groove having a pair of sidewalls, said other interengaging fastener element having an extending rib defined by a pair of sidewalls, said other fastener element rib slidingly engaging said one interengaging fastener element groove.

11. The package of claim 1, wherein said other interengaging fastener element is disposed on said inner surface of said covering film sheet, said covering film including a portion proximate to said other interengaging fastener element and defining a pull flange of said package.

12. The package of claim 1, wherein said pair of interengaging fastener elements include zipper elements.

13. The package of claim 1, wherein said other of said pair of interengaging fastener elements is integrally formed in said covering film sheet.

14. The package of claim 1, wherein said pair of interengaging fastener elements include rib and groove members.

15. The package of claim 1 wherein said one interengaging fastener element integrally formed in said backing board has a length less than a corresponding length of said backing board, thereby defining two positive contact areas between said backing board and said covering film at opposite, longitudinal ends of said one interengaging fastener element, said hermetic package seal extending into said two positive contact areas and extending further exterior of said recloseable seal.

16. The package of claim 10 wherein said one interengaging fastener element groove pair of sidewalls are substantially vertical and parallel to each other and said other interengaging fastener element rib pair of sidewalls are substantially vertical and parallel to each other.

17. The package of claim 10 wherein said one interengaging fastener element groove pair of sidewalls are angled with regard to each other and said other interengaging fastener element extending rib paid of sidewalls are complementary with respect to said one interengaging fastener element groove pair of sidewalls.

* * * * *